US006513415B2

(12) United States Patent
Vaske et al.

(10) Patent No.: US 6,513,415 B2
(45) Date of Patent: Feb. 4, 2003

(54) PROPELLANT RETENTION DEVICE

(75) Inventors: James G. Vaske, Inver Grove Heights, MN (US); Timothy J. Doering, Anoka, MN (US); Joel Martin, Minnetonka, MN (US); Michael Loge, Andover, MN (US)

(73) Assignee: United Defense LP, Arlington, VA (US)

( * ) Notice: Subject to any disclaimer, the term of this patent is extended or adjusted under 35 U.S.C. 154(b) by 0 days.

(21) Appl. No.: 09/814,892

(22) Filed: Mar. 22, 2001

(65) Prior Publication Data

US 2002/0134225 A1 Sep. 26, 2002

(51) Int. Cl.[7] ..... F41A 9/00
(52) U.S. Cl. ..... 89/45; 89/46; 89/47; 89/33.01
(58) Field of Search ..... 89/45, 46, 47, 89/33.01, 33.05, 34

(56) References Cited

U.S. PATENT DOCUMENTS

| | | | | |
|---|---|---|---|---|
| 3,500,718 | A | * | 3/1970 | Stoner |
| 4,393,748 | A | | 7/1983 | Hallqvist |
| 4,457,209 | A | | 7/1984 | Scheurich et al. |
| 4,495,853 | A | | 1/1985 | Gottwaldt |
| 4,677,894 | A | * | 7/1987 | Pongratz et al. |
| 4,763,559 | A | | 8/1988 | Bouillon |
| 4,823,675 | A | * | 4/1989 | Sciele et al. |
| 4,852,461 | A | | 8/1989 | von Laar et al. |
| 4,860,633 | A | * | 8/1989 | Wiethoff et al. |
| 4,991,489 | A | * | 2/1991 | Lindberg |
| 5,223,663 | A | * | 6/1993 | Bender-Zanoni et al. |
| 5,261,310 | A | | 11/1993 | Sullivan et al. |
| 5,335,581 | A | | 8/1994 | Simon et al. |
| 5,526,730 | A | * | 6/1996 | Zangrando |
| 5,563,363 | A | * | 10/1996 | Soulaigre et al. |
| 5,591,932 | A | | 1/1997 | Staiert et al. |
| 5,677,507 | A | | 10/1997 | Becker et al. |
| 5,773,747 | A | | 6/1998 | Tellander et al. |
| 5,811,721 | A | * | 9/1998 | Andersson |
| 5,831,201 | A | | 11/1998 | Andersson et al. |
| 5,837,923 | A | | 11/1998 | Gay et al. |
| 5,844,163 | A | | 12/1998 | Lindskog |
| 5,880,395 | A | | 3/1999 | Krumm et al. |
| 6,026,729 | A | | 2/2000 | Hallqvist |

FOREIGN PATENT DOCUMENTS

| | | |
|---|---|---|
| GB | 2260390 A | 4/1993 |
| JP | 3-291497 | 12/1991 |

OTHER PUBLICATIONS

Web site print–out: FAS Military Analysis Network, *Crusader*, 6 pgs., Nov. 21, 2000.

* cited by examiner

*Primary Examiner*—Michael J. Carone
*Assistant Examiner*—Troy Chambers
(74) *Attorney, Agent, or Firm*—Patterson, Thuente, Skaar & Christensen, P.A.

(57) ABSTRACT

A dual action retention pawl for securing ammunition in a breech loading gun having a bore along a longitudinal axis of a barrel of the gun and a breech opening with a moveable breech block at a rear of the bore. The dual action retention pawl includes a base, a pawl arm, and an activation arm operably attached to the base. The pawl arm pivots to a retracted position in response to ammunition engaging the activation arm when the ammunition is loaded into the breech opening and returns to a retention position once the ammunition is loaded to retain the ammunition within the barrel of the gun. The pawl arm pivots to the retracted position in response to the breech block engaging the activation arm when the breech block is moved to close the breech opening.

39 Claims, 6 Drawing Sheets

PROPELLANT RETENTION DEVICE

FIELD OF THE INVENTION

The present invention relates generally to a propellant retention device. More particularly, the present invention relates to a retention pawl for retaining modular propellant increments in a gun barrel during a loading process.

BACKGROUND OF THE INVENTION

Traditionally, most larger caliber guns, such as guns having a caliber of greater than 105 millimeters, are loaded with ammunition from a breech end of the gun barrel. This process typically involves removing a breech block from the breech end of the gun barrel to provide access to the breech end of the gun barrel. Next, a projectile is inserted into the gun barrel. Propellant is then placed into the gun barrel and the breech block is positioned over the breech end of the gun barrel.

To enhance the ease of loading propellant into the gun barrel, the propellant is usually packaged in modular increments. By changing the number of increments loaded, the amount of force imparted to the projectile during the firing process can be varied.

In most breech loading guns that separately load propellant, a lower surface of the gun barrel has a depression that forms a lip in the gun barrel. This lip is often referred to as a Swiss notch. As propellant increments are inserted into the gun barrel, the propellant increments are prevented from sliding backwardly out of the gun barrel by the lip. Once all of the propellant increments are loaded into the gun barrel, the breech block is moved into position behind the breech end of the gun barrel and thereby prepare the gun for firing.

In order for the lip to be effective at retaining the propellant increments in the gun barrel, the gun barrel must be rotated to a substantially horizontal orientation before initiating the loading process. Such a procedure is particularly suited for manual loading processes because it is difficult for a person performing the loading process to insert the projectile and the propellant into the gun barrel when the gun barrel is oriented at an angle that substantially deviates from horizontal.

It can be appreciated that the time needed to perform the loading operation is significantly increased by lowering the gun barrel from the desired firing orientation to a horizontal loading orientation. Additionally, once the gun is reloaded it must be raised from the loading orientation to the desired firing orientation before firing the gun.

SUMMARY OF THE INVENTION

The present invention relates to a dual action retention pawl for securing ammunition components in a breech loading gun. The gun has a barrel with a bore along a longitudinal axis of the barrel. The gun also has a breech opening with a moveable breech block at a rear of the bore. The dual action retention pawl includes a base, a pawl arm and an activation arm.

The base is operably attached to the barrel of the gun. The pawl arm and an activation arm are operably attached to the base such that the pawl arm pivots to a retracted position in response to an ammunition component engaging the activation arm when the ammunition component is loaded into the breech opening and returns to a retention position once the ammunition component is loaded to retain the ammunition component within the barrel of the gun. The pawl arm pivots to the retracted position in response to the breech block engaging the activation arm when the breech block is moved to close the breech opening.

DETAILED DESCRIPTION OF PREFERRED EMBODIMENTS

Figure 1:
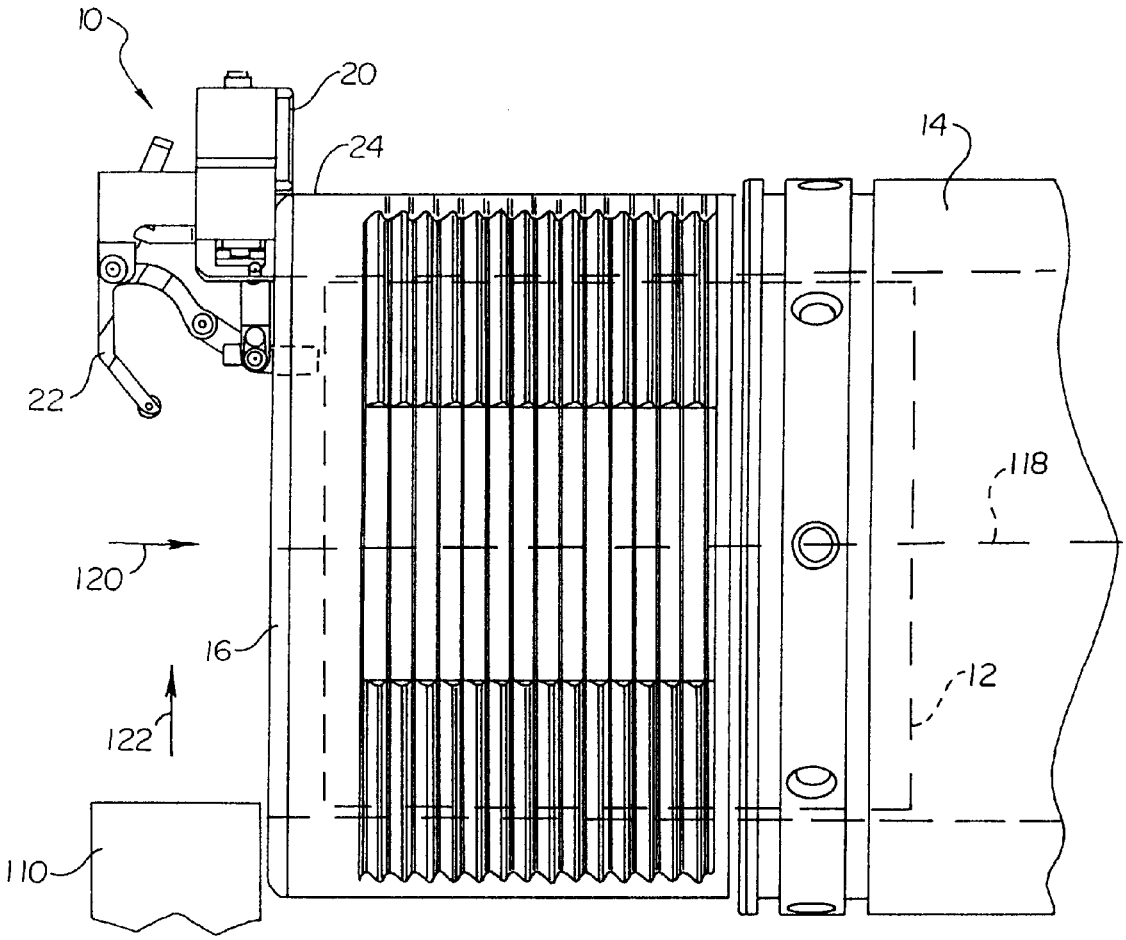
FIG. 1 is a side view of a propellant retention device of the present invention attached to a gun barrel.
Figure 2:
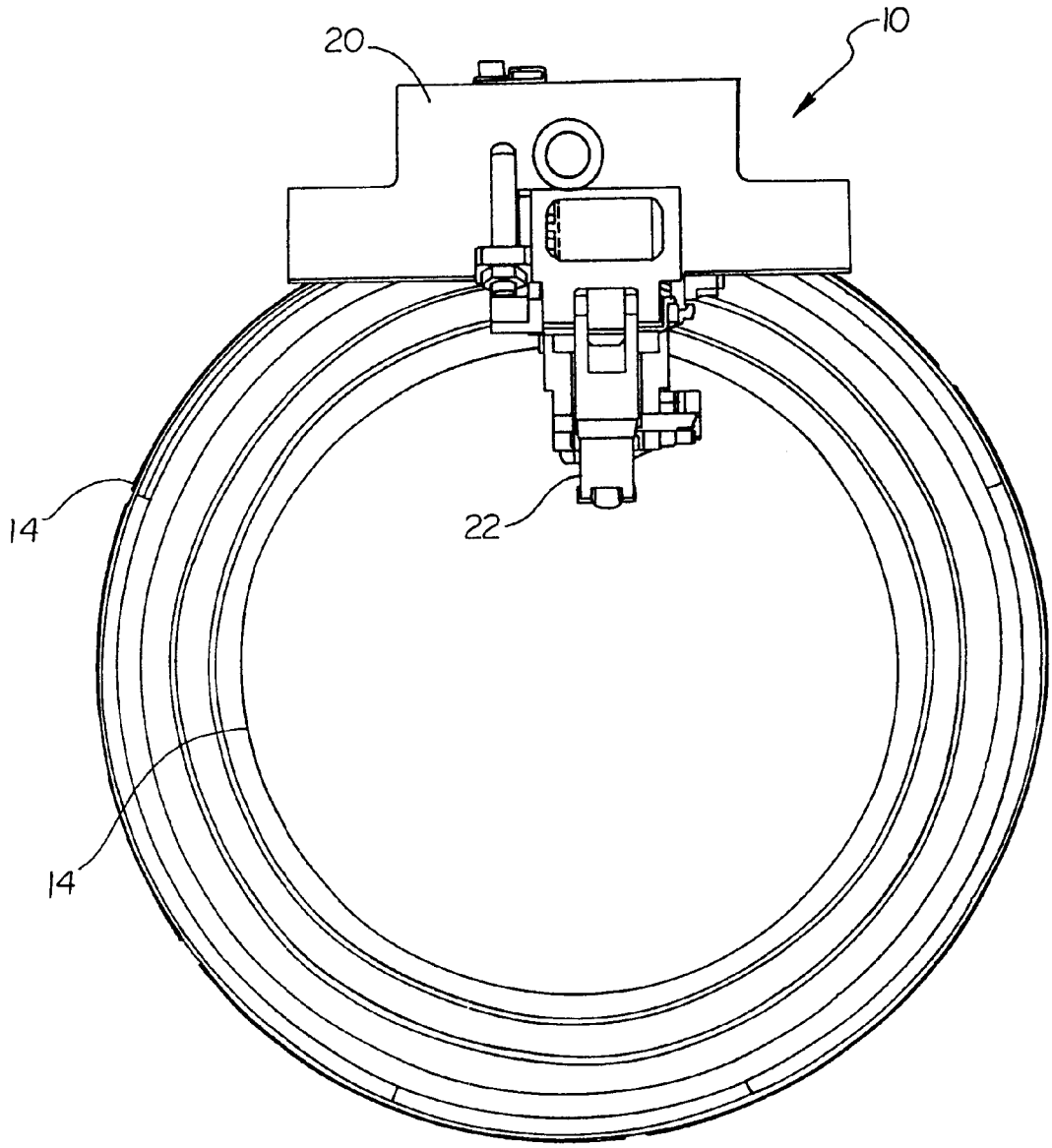
FIG. 2 is a front view of the propellant retention device attached to the gun barrel.

The present invention is directed to a propellant retention device, as most clearly illustrated at 10 in FIGS. 1 and 2. The propellant retention device 10 retains ammunition components 12 as they are loaded into a gun barrel 14. Ammunition components 12 can include one or more projectile and one or more modular propellant packets or increments.

The propellant retention device 10 prevents ammunition components 12 from falling out of a breech end 16 of the gun barrel 14 during manual or automated loading processes. The propellant retention device 10 of the present invention thereby enhances the ease and safety of the loading process. The propellant retention device 10 also enhances the ability to reload the gun at a variety of orientations including orientations that are near vertical.

The propellant retention device 10 is particularly suited for use with larger size guns where the propellant is loaded separately from the projectile. The gun barrel 14 preferably has a caliber of greater than 50 millimeters and, more preferably, is about 155 millimeters.

The propellant retention device 10 generally includes a base 20 and an arm assembly 22. The base 20 is mounted to an outer surface 24 of the gun barrel 14 proximate to the breech end 16 of the gun barrel 14.

The arm assembly 22 preferably has an over center configuration. When in a retention position, the arm assembly 22 extends preferably about 30 millimeters into the gun barrel 14. When in the retracted position, the arm assembly 22 does not intrude into the gun barrel 14 to thereby permit the breech end 16 of the gun barrel 14 to be sealed for firing.

Figure 3:
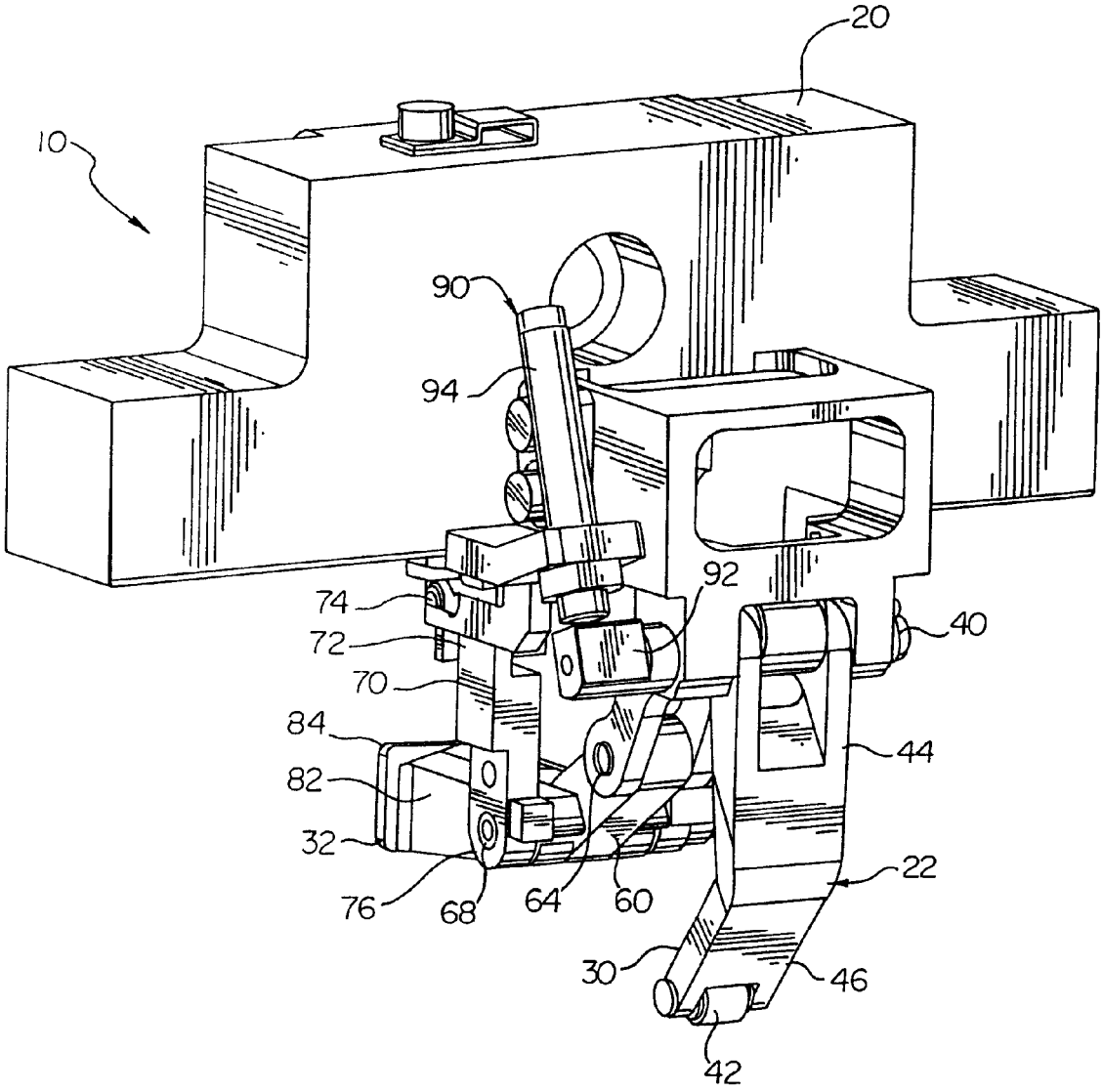
FIG. 3 is a perspective view of the propellant retention device in a retention configuration.
Figure 4:
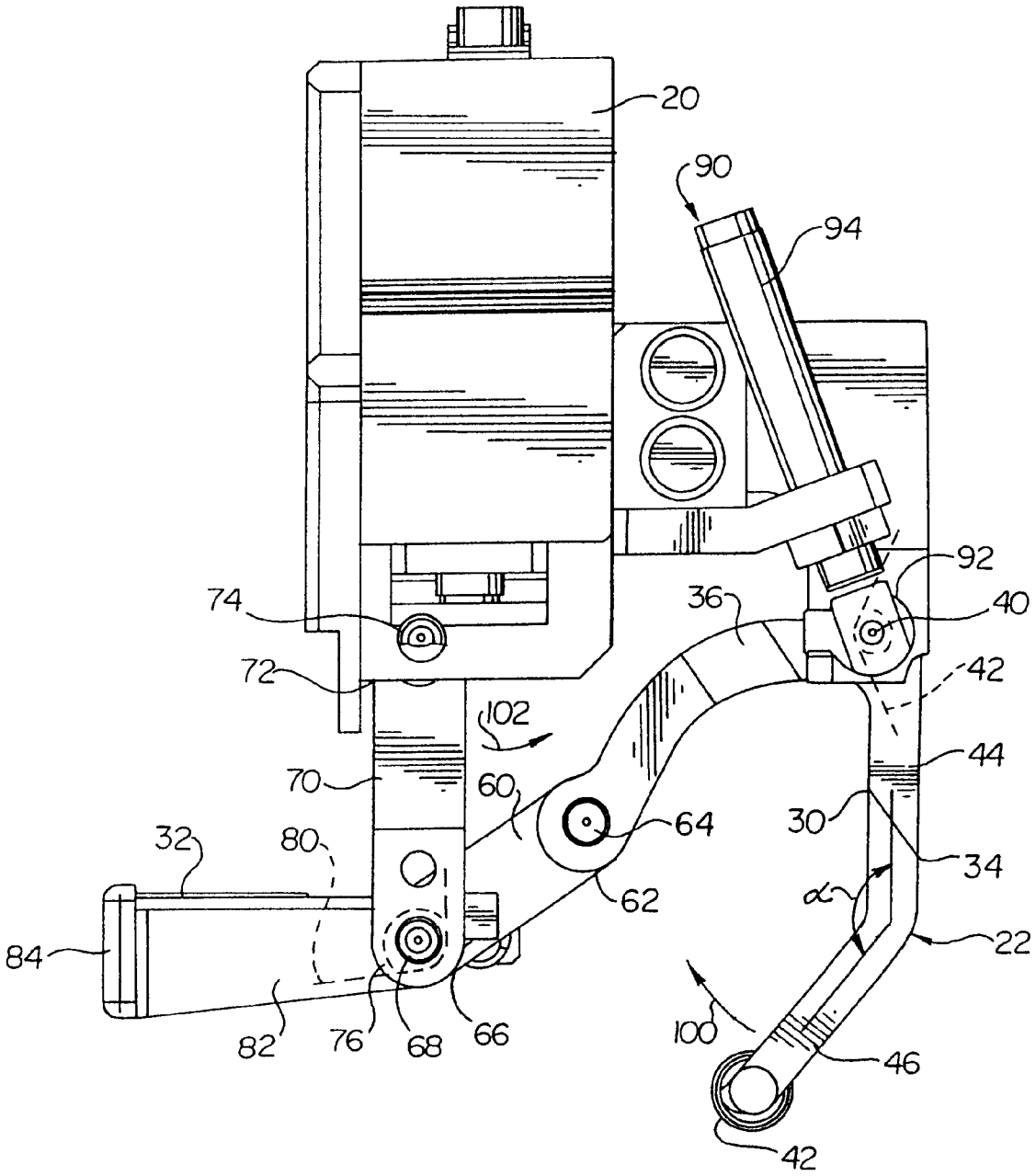
FIG. 4 is a side view of the propellant retention device in the retention position.
Figure 5:
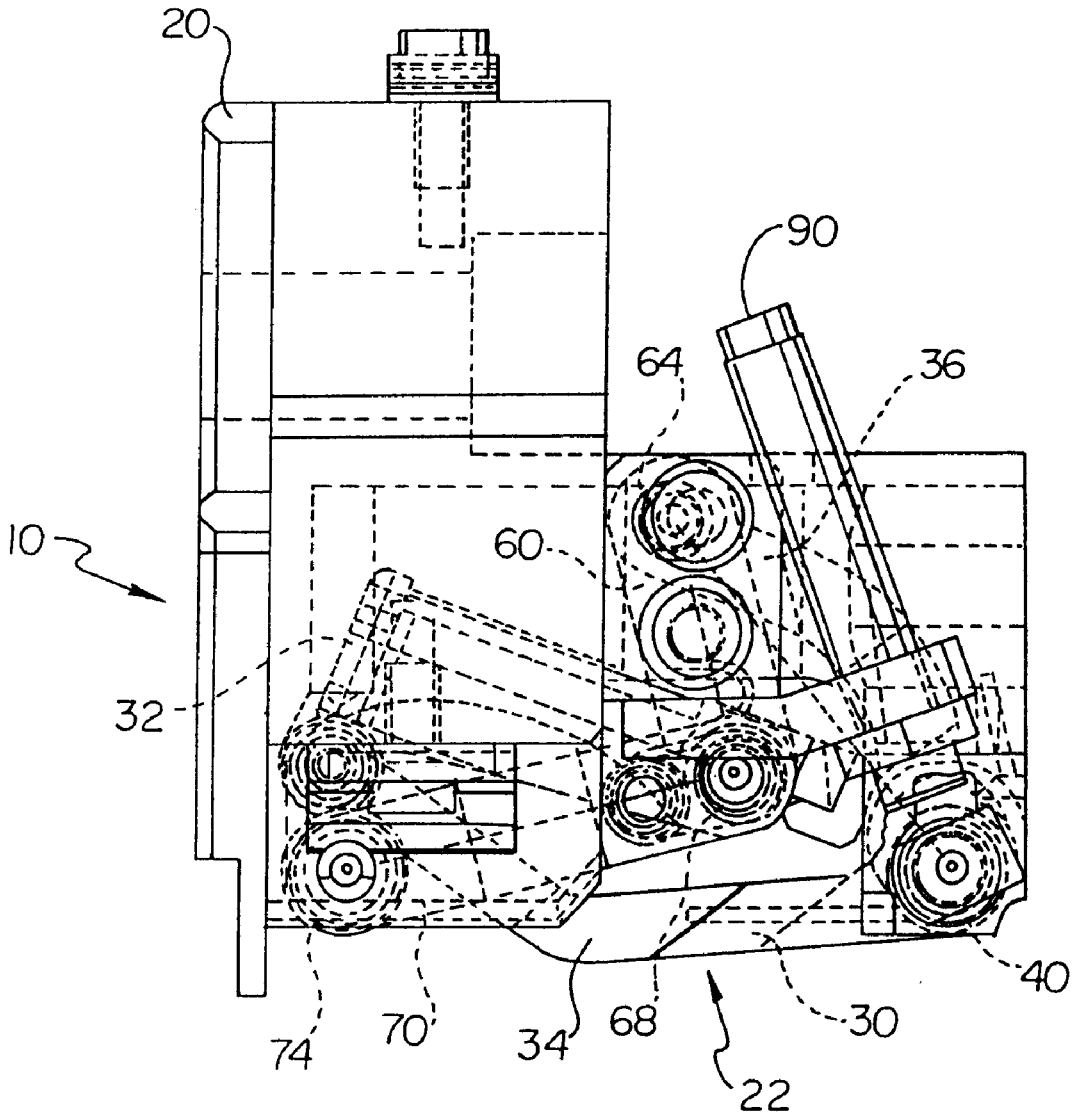
FIG. 5 is a side view of the propellant retention device in a fully retracted position.

The arm assembly 22 generally includes activation arm 30 and a retention pawl 32, as most clearly illustrated in FIGS. 3 and 4. The retention pawl 32 is operably attached to the activation arm 30 such that movement of the activation arm 30 between the retention position, as illustrated in FIG. 4, and a retracted position, as illustrated in FIG. 5, causes the retention pawl 32 to move between the retention position, as illustrated in FIG. 4, and a retracted position, as illustrated in FIG. 5.

The activation arm 30 preferably has a generally U-shaped configuration, as most clearly illustrated in FIGS. 3 and 4. A first leg 34 of the activation arm 30 is used for moving the propellant retention device 10 between the retention and retracted positions. A second leg 36 operably connects the activation arm 30 to the retention pawl 32.

The activation arm 30 is pivotally attached to the base 20 intermediate the first leg 34 and the second leg 36 for rotation about a first mounting shaft 40. A biasing mechanism 42, such as a spring, urges the activation arm 30 to the retention position.

Opposite the first mounting shaft 40, the first leg 34 preferably includes a roller 42 rotatably mounted thereto. The roller 42 has a diameter that is slightly greater than a thickness of the first leg 34 so that the roller 42 extends above the side and end surfaces of the first leg 34. The roller 42 enhances the ability to slide the ammunition components 12 past the activation arm 30.

To further enhance the ability to move the ammunition components 12 past the activation arm 30, the activation arm 30 preferably includes a lower region 46 and an upper region 44 that are oriented at an angle with respect to each other. The angle $\alpha$ between the lower region 46 and the upper region 44 is less than 180°, preferably between 120° and 170°, and more preferably about 140°.

The retention pawl 32 is preferably operatively attached to the second leg 36 of the activation arm 30 using a first connecting member 60. A first end 62 of the first connecting member 60 is pivotally attached to the second leg 36 using a second mounting shaft 64. A second end 66 of the first connecting member 60 is pivotally attached to the retention pawl 32 with a third mounting shaft 68. The second leg 36 preferably includes two leg sections that are oriented on either side of the first connecting member 60.

The retention pawl 32 is preferably operatively attached to the base 20 using a second connecting member 70. A first end 72 of the second connecting member 70 is pivotally attached to the base using a fourth mounting shaft 74. A second end 76 of the second connecting member 70 is pivotally attached to the retention pawl 32 with the third mounting shaft 68.

The second connecting member 70 preferably includes two sections that are attached on either side of the retention pawl 32. The two sections are preferably shaped substantially identical to each other. Using the two section configuration enhances the lateral stability of the retention pawl 32.

The third mounting shaft 68 also pivotally attaches the first connecting member 60 to the second connecting member 70. A biasing mechanism 80, such as a spring, urges the retention pawl 32 to pivot away from the second connecting member 70 towards the retention position.

The retention pawl 32 preferably includes an elongated main portion 82 and an end portion 84. The end portion 84 is oriented substantially perpendicular to the main portion 82 and thereby provides a relatively large surface that retains the ammunition components 12 in the gun barrel 14.

The propellant retention mechanism 10 also preferably includes a sensor mechanism 90 that senses whether the propellant retention mechanism 10 is in the retention position. The sensor mechanism 90 thereby provides an additional level of safety during the propellant loading process. For example, if the sensor mechanism 90 senses that the propellant retention mechanism 10 does not return to the retention position after the insertion of the ammunition components 12 into the gun barrel 14, the sensor mechanism 90 notifies the operator of the error and halts the automatic loading process.

The sensor mechanism 90 preferably includes a cam 92 attached to an end of the first mounting shaft 40. The cam 92 includes at least one region that has a greater height. The sensor mechanism 90 also includes a sensor 94 that is attached to the base 20. Certain angular orientations of the cam 92 engage the sensor 94 and thereby indicate that the propellant retention device 10 is in an appropriate angular orientation. A person of ordinary skill in the art will appreciate that it is possible to sense the position of the propellant retention device 10 using a variety of techniques using the concepts of the present invention.

The components of the propellant retention device 10 are preferably fabricated from high strength metallic materials such as steel. The thickness of the individual components is selected such that the components do not exhibit deformation over repeated uses of the propellant retention device 10. A person of ordinary skill in the art will appreciate that care must be taken selecting components with sufficient structural integrity to withstand deformation as failure of the propellant retention device 10 can lead to damage of the ammunition components 12 thereby creating a significant risk of injury to people or equipment in close proximity thereto.

In operation, the propellant retention device 10 is initially in the retention position, as illustrated in FIGS. 1 and 4. During the process of inserting the ammunition components 12, the ammunition component 12 slides along a central axis 118 of the gun barrel 14, as indicated by arrow 120 in FIG. 1, and contacts the upper portion 44 of the activation arm 30. The ammunition component 12 urges the activation arm 30 to pivot towards the base 20, as indicated by arrow 100. As noted above, the term ammunition component 12 encompasses both the projectile and the propellant increments.

Pivoting of the activation arm 30 towards the base 20 causes the first connecting arm 60 to pivot the second connecting member 70 towards the activation arm 30, as indicated by arrow 102. Continued pivoting of the activation arm 30 causes the arm assembly 22 to be further retracted into the base 20.

Figure 6:
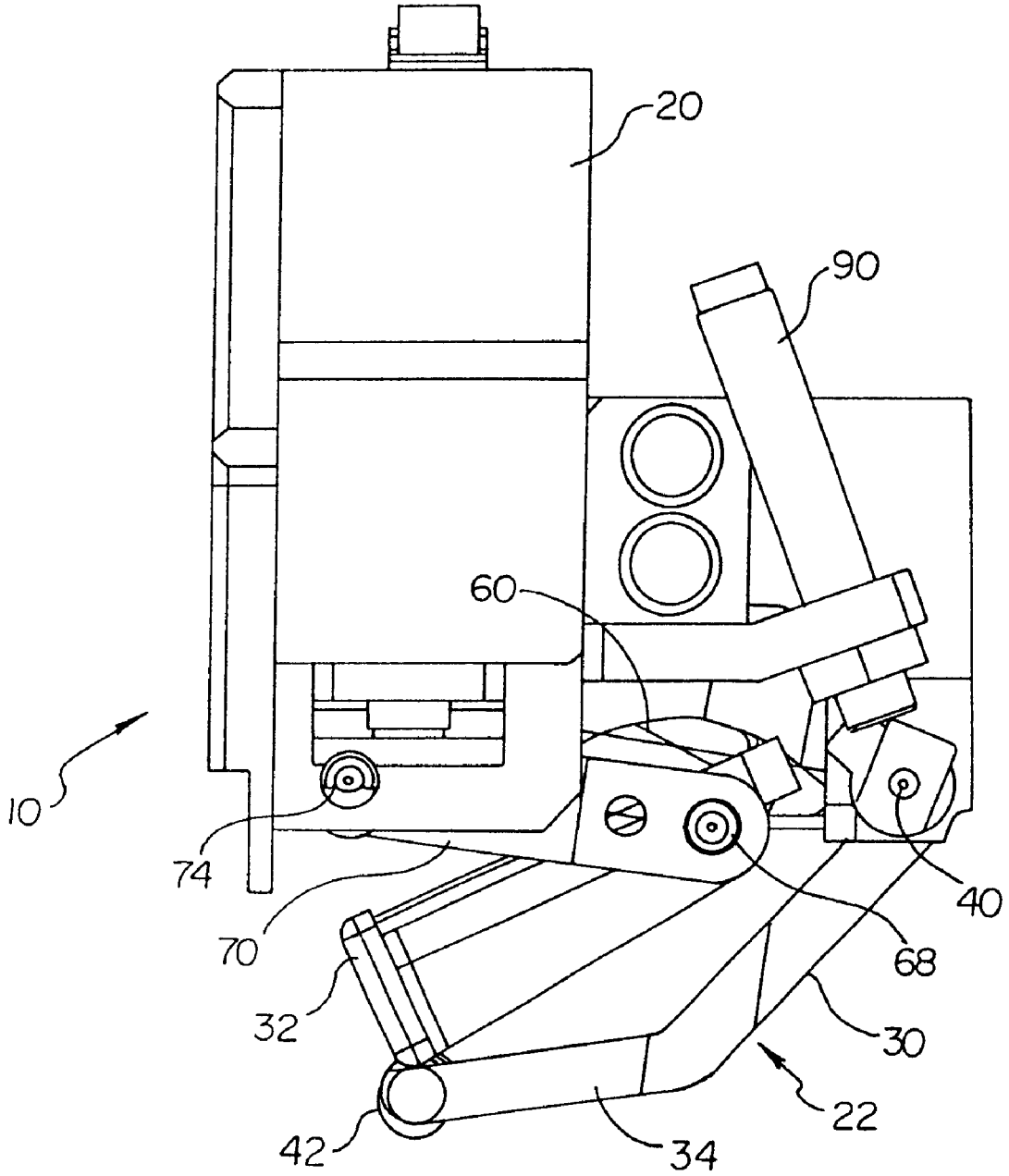
FIG. 6 is a side view of the propellant retention device in a partially retracted position.

The activation arm 30 then contacts the retention pawl 32 and causes the retention pawl 32 to be further pivoted into the base 20, as illustrated in FIG. 6. Pivoting continues until the ammunition component 12 may slide past the activation arm 30 and into the gun barrel 14.

Once the ammunition component 12 moves past the end of the activation arm 30, the force of the spring 42 causes the activation arm 30 to pivot back to the retention position. Pivoting of the activation arm 30 causes the second connecting member 70 to pivot with respect to the base 20. This process continues until the activation arm 30 is in the retention position. The spring 80 biases the retention pawl 32 away from the second connecting member 70. The retention pawl 32 is thereby positioned in the breech end 16, as illustrated in FIG. 1. of the gun barrel 14 to prevent the propellant packet from falling out of the gun barrel 14.

During this process, the projectile and from 1 to 6 propellant increments 12 are loaded into the gun barrel 14. The structure of the propellant retention device 10 of the present invention is particularly suited for automatic propellant loading operations to thereby increase the safety associated with this process.

After all of the ammunition components 12 have been inserted into the gun barrel 14, it is necessary for a breech block 110 to be moved into position over the breech end 16 of the gun barrel 14 prior to firing. The breech block 110 is preferably slid along an axis that is substantially perpendicular to the central axis 118 of the gun barrel 14, as indicated by arrow 122 in FIG. 1, and contacts the lower portion 46 of the activation arm 30 and urges the activation arm 30 to pivot towards the base 20, as indicated by arrow 100 in FIG. 4.

Pivoting of the activation arm 30 towards the base 20 causes the first connecting arm 60 to pivot the second connecting member 70 towards the activation arm 30 as indicated by arrow 102. Continued pivoting of the activation arm 30 causes the components of the propellant retention device 10 to be further retracted into the base 20.

The activation arm 30 then contacts the retention pawl 32 and causes the retention pawl 32 to be further pivoted into the base 20, as illustrated in FIG. 6. Pivoting continues until the activation arm 30 and the retention pawl 32 are located substantially within the base 20, as illustrated in FIG. 5. At this point, the breech block 110 is fully closed and ready to fire.

After the gun is fired and it is necessary to reload the gun, the breech block 110 is slid away from the breech end 16 of the gun barrel 14. As the breech block 110 moves away from the propellant retention device 10, the force of the spring 42 causes the activation arm 30 to pivot towards the retention position. Pivoting of the activation arm 30 causes the second connecting member 70 to pivot with respect to the base 20. This process continues until the activation arm 30 is in the retention position. The spring 80 biases the retention pawl 32 away from the second connecting member 70. The retention pawl 32 is thereby positioned in the breech end 16, as illustrated in FIG. 1.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A dual action retention pawl for securing ammunition components in a breech loading gun having a bore along a longitudinal axis of a barrel of the gun and a breech opening with a moveable breech block at a rear of the bore, the dual action retention pawl comprising:

a base operably attached to the barrel of the gun; and a pawl arm and an activation arm operably attached to the base such that the pawl arm pivots to a retracted position in response to an ammunition component engaging the activation arm when the ammunition component is loaded into the breech opening and returns to a retention position once the ammunition component is loaded to retain the ammunition component within the barrel of the gun, and the pawl arm pivots to the retracted position in response to the breech block engaging the activation arm when the breech block is moved to close the breech opening.

2. The dual action retention pawl of claim 1, wherein the retention pawl at least partially nests in the activation arm when in the retracted position.

3. The dual action retention pawl of claim 1, further comprising a first biasing mechanism that biases the activation arm to the retention position.

4. The dual action retention pawl of claim 1, wherein the activation arm has a U-shaped configuration with a first leg and a second leg, and wherein the activation arm is attached to the base intermediate the first leg and the second leg.

5. The dual action retention pawl of claim 1. and further comprising:

a first connecting member operably attaching the activation arm to the retention pawl; and a second connecting member operably attaching the retention pawl to the base.

6. The dual action retention pawl of claim 5, and further comprising a second biasing mechanism that biases the retention pawl to the retention position.

7. The dual action retention pawl of claim 1, and further comprising a sensor mechanism that senses when the activation arm is in the retention position.

8. The dual action retention pawl of claim 7, wherein the sensor mechanism includes a cam operably attached to the activation arm.

9. A breech loading gun comprising:

a barrel having a bore aligned along a longitudinal axis thereof, wherein the barrel has a breech opening;

a breech block for selectively covering the breech opening; and a dual action retention pawl comprising:

a base operably attached to the barrel of the gun; and a pawl arm and an activation arm operably attached to the base such that the pawl arm pivots to a retracted position in response to an ammunition component engaging the activation arm when the ammunition component is loaded into the breech opening and returns to a retention position once the ammunition component is loaded to retain the ammunition component within the barrel of the gun, and the pawl arm pivots to the retracted position in response to the breech block engaging the activation arm when the breech block is moved to close the breech opening.

10. The breech loading gun of claim 9, wherein the retention pawl at least partially nests in the activation arm when in the retracted position.

11. The breech loading gun of claim 9, and further comprising a first biasing mechanism that biases the activation arm to the retention position.

12. The breech loading gun of claim 9, wherein the activation arm has a U-shaped configuration with a first leg and a second leg, and wherein the activation arm is attached to the base intermediate the first leg and the second leg.

13. The breech loading gun of claim 9, and further comprising:

a first connecting member operably attaching the activation arm to the retention pawl; and a second connecting member operably attaching the retention pawl to the base.

14. The breech loading gun of claim 13, and further comprising a second biasing mechanism that biases the retention pawl to the retention position.

15. The breech loading gun of claim 9, and further comprising a sensor mechanism that senses when the activation arm is in the retention position.

16. The propellant retention device of claim 15, wherein the sensor mechanism includes a cam operably attached to the activation arm.

17. A method of retaining propellant increments in a gun barrel, the method comprising:

providing a gun barrel having a bore extending therethrough and having a breech end;

attaching a retention pawl with respect to the gun barrel so that the retention pawl is pivotable between a retention position at least partially in the bore and a retracted substantially position outside the bore;

attaching an activation arm with respect to the gun barrel; and operably connecting the activation arm to the retention pawl so that pivoting of the activation arm between a retention position and a retracted position causes the retention pawl to pivot between the retention position and the retracted position.

18. The method of claim 17, and further comprising loading propellant increments into the breech end of the gun barrel through the bore, wherein the propellant increments cause the retention pawl and the activation arm to move from the retention position to the retracted position as the propellant increments are passing into the breech end of the gun barrel.

19. The method of claim 18, and further comprising sliding a breech block to cover the bore, wherein the breech block causes the retention pawl and the activation arm to move from the retention position to the retracted position as the breech block slides over the breech end of the gun barrel.

20. The method of claim 18, wherein the retention pawl and the activation arm move from the retracted position to the retention position after the propellant increments pass into the breech end of the gun barrel.

21. The method of claim 18, wherein the propellant increments are loaded into the gun barrel along a central axis thereof.

22. The method of claim 17, and further comprising moving a breech block to cover the breech end of the gun barrel bore, wherein the breech block causes the retention pawl and the activation arm to move from the retention position to the retracted position.

23. The method of claim 22, wherein the breech block is moved substantially perpendicular to a central axis of the gun barrel.

24. The method of claim 17, wherein the retention pawl at least partially nests in activation arm when in the retracted position.

25. The method of claim 17, wherein the activation arm and the retention pawl pivot towards each other when moving from the retention position to the retracted position.

26. The method of claim 17, and further comprising biasing the activation arm to the retention position.

27. The method of claim 17, and further comprising operably attaching the activation arm to the retention pawl with linkage having an over-center configuration.

28. The method of claim 27, and further comprising:

pivotally attaching the activation arm to the retention pawl with a first connecting member; and pivotally attaching the retention pawl to the base with a second connecting member.

29. The method of claim 17, and further comprising biasing the retention pawl to the retention position.

30. The method of claim 17, and further comprising sensing when the activation arm is in the retention position.

31. A method of securing ammunition in a breech loading gun, the method comprising:

providing a barrel with a bore aligned along a longitudinal axis thereof, wherein the barrel has a breech opening;

mounting a breech block to the barrel proximate the breech opening;

operably attaching a base to the barrel proximate breech opening;

operably attaching a pawl arm and an activation arm to the base;

pivoting the pawl arm to a retracted position in response to an ammunition component when the ammunition component is loaded into the breech opening;

pivoting the pawl arm to a retention position once the ammunition component is loaded to retain the ammunition component within the barrel of the gun; and pivoting the pawl arm to the retracted position in response to the breech block engaging the activation arm when the breech block is moved to close the breech opening.

32. The method of claim 31, wherein the retention pawl moves from the retracted position to the retention position after the propellant increment passes into the breech end.

33. The method of claim 31, wherein the retention pawl at least partially nests in activation arm when in the retracted position.

34. The method of claim 31, wherein the activation arm and the retention pawl pivot towards each other when moving from the retention position to the retracted position.

35. The method of claim 31, and further comprising biasing the activation arm to the retention position.

36. The method of claim 31, and further comprising operably attaching the activation arm to the retention pawl with linkage having an over-center configuration.

37. The method of claim 36, and further comprising:

pivotally attaching the activation arm to the retention pawl with a first connecting member; and pivotally attaching the retention pawl to the base with a second connecting member.

38. The method of claim 31, and further comprising biasing the retention pawl to the retention position.

39. The method of claim 31, and further comprising sensing when the activation arm is in the retention position.

* * * * *